US011600222B2

(12) United States Patent
Tseng et al.

(10) Patent No.: US 11,600,222 B2
(45) Date of Patent: Mar. 7, 2023

(54) LIGHT-EMITTING CIRCUIT HAVING BYPASS CIRCUIT FOR REDUCING THE POSSIBILITY OF THE LIGHT-EMITTING UNIT ILLUMINATING IN THE DARK STATE

(71) Applicant: InnoLux Corporation, Miao-Li County (TW)

(72) Inventors: Ming-Chun Tseng, Miao-Li County (TW); Kung-Chen Kuo, Miao-Li County (TW); Lien-Hsiang Chen, Miao-Li County (TW); Chi-Lun Kao, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 17/519,624

(22) Filed: Nov. 5, 2021

(65) Prior Publication Data

US 2022/0198999 A1 Jun. 23, 2022

Related U.S. Application Data

(60) Provisional application No. 63/129,855, filed on Dec. 23, 2020.

(30) Foreign Application Priority Data

Aug. 6, 2021 (CN) ..... 202110901223.5

(51) Int. Cl.
*G09G 3/32* (2016.01)

(52) U.S. Cl.
CPC ..... *G09G 3/32* (2013.01); *G09G 2300/0842* (2013.01); *G09G 2310/0278* (2013.01); *G09G 2330/021* (2013.01)

(58) Field of Classification Search
CPC ..... G09G 3/32; G09G 2300/0842; G09G 2310/0278; G09G 2330/021
See application file for complete search history.

(56) References Cited

U.S. PATENT DOCUMENTS

| | | | | |
|---|---|---|---|---|
| 8,129,916 | B2 | 3/2012 | Godbole | |
| 10,600,365 | B2 | 3/2020 | Jeong et al. | |
| 2003/0142052 | A1* | 7/2003 | Matsumoto | G09G 3/3648 345/87 |
| 2010/0091001 | A1* | 4/2010 | Kim | G09G 3/3225 345/76 |
| 2019/0147798 | A1* | 5/2019 | Hwang | G09G 3/3266 345/691 |

FOREIGN PATENT DOCUMENTS

TW I590216 B 7/2017

* cited by examiner

*Primary Examiner* — Michael A Faragalla
*Assistant Examiner* — Sujit Shah
(74) *Attorney, Agent, or Firm* — McClure, Qualey & Rodack, LLP

(57) ABSTRACT

A light-emitting circuit is provided herein, which includes a light-emitting unit, a driving transistor, and a bypass transistor. The driving transistor is configured to drive the light-emitting unit. The bypass circuit diverts the current flowing from the driving transistor to the light-emitting unit for reducing the possibility of the light-emitting unit illuminating in the dark state.

13 Claims, 10 Drawing Sheets

LIGHT-EMITTING CIRCUIT HAVING BYPASS CIRCUIT FOR REDUCING THE POSSIBILITY OF THE LIGHT-EMITTING UNIT ILLUMINATING IN THE DARK STATE

CROSS REFERENCE TO RELATED APPLICATIONS

This application claims the benefit of U.S. Provisional Application No. 63/129,855, filed on Dec. 23, 2020, and claims priority of China Patent Application No. 202110901223.5, filed on Aug. 6, 2021, the entirety of which are incorporated by reference herein.

BACKGROUND OF THE INVENTION

Field of the Invention

The disclosure is generally related to a light-emitting circuit, and more particularly it is related to a light-emitting circuit having a bypass circuit for reducing the possibility of the light-emitting unit illuminating in the dark state.

Description of the Related Art

At present, the driving circuits used for driving light-emitting units used in display technology mainly include thin film transistors. With the vigorous development of electronic products, the requirements for display quality on electronic products are getting higher and higher. As the size of the thin film transistor on the display device becomes larger and larger, the leakage current of the thin film transistor being turned off is getting larger and larger, which may even lead to the light-emitting unit illuminating while in a dark state, which affects the effectiveness of the display.

Therefore, it would be required to optimize the leakage current in the light-emitting circuit.

BRIEF SUMMARY OF THE INVENTION

A light-emitting circuit is provided herein. The light-emitting circuit includes a light-emitting unit, a driving transistor, and a bypass transistor. The driving transistor is configured to generate a driving current to drive the light-emitting unit and generates a leakage current. The bypass circuit is electrically connected to a node between the light-emitting unit and the driving transistor and diverts the leakage current, thereby reducing the possibility of the leakage current flowing through the light-emitting unit.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
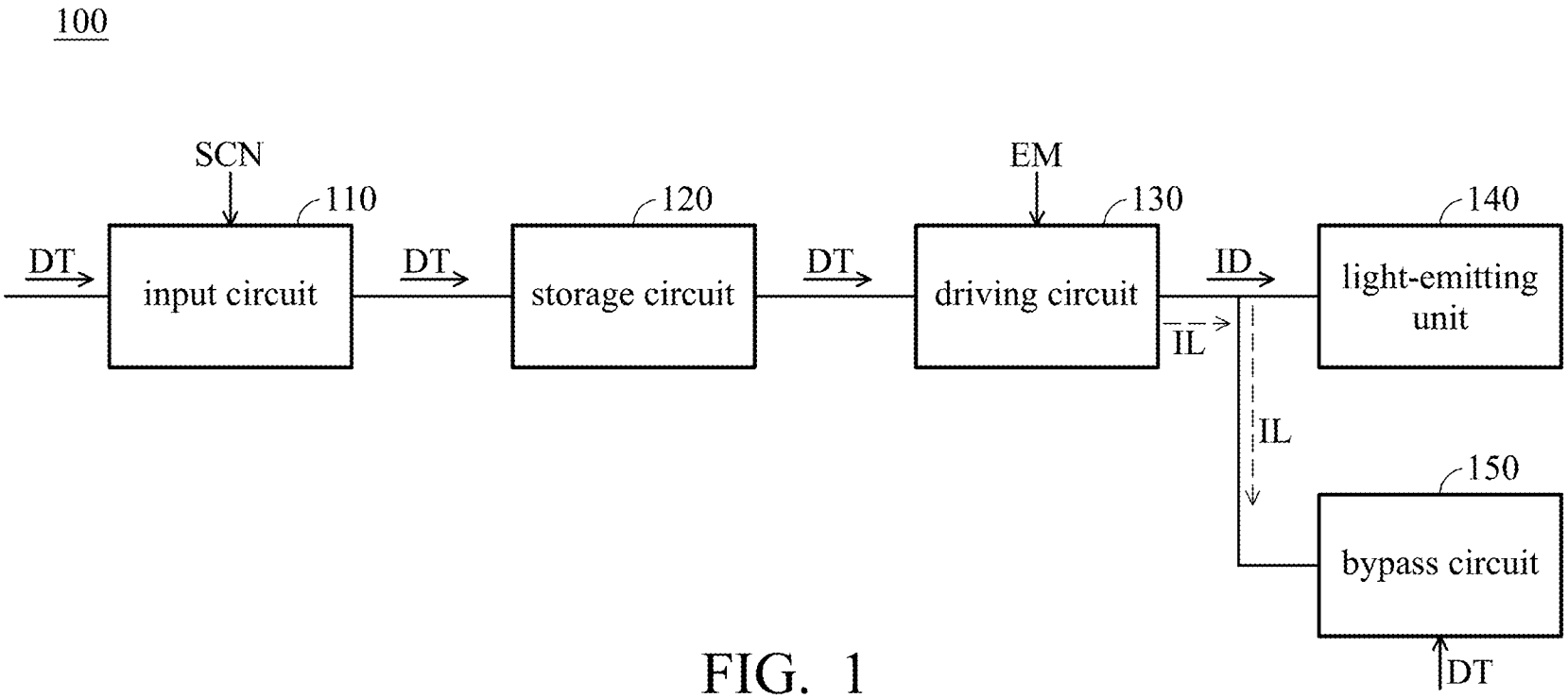
FIG. 1 is a block diagram of a light-emitting circuit in accordance with an embodiment of the present disclosure.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It would be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It is understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. Furthermore, the terms of joining and connecting may also include the case where both structures are movable or both structures are fixed. In addition, the term "coupled" includes any direct and indirect electrical connection means.

The electrical connection or coupling described in this disclosure may refer to direct connection or indirect connection. In the case of direct connection, the terminals of two devices in a circuit are directly connected or connected to each other through a conducting line. In the case of indirectly connection, there are switches, diodes, capacitors, inductors, resistors, other suitable components or a combination of the components mentioned above between the terminals of two devices in a circuit, but it is not intended to be limited thereto.

FIG. 1 is a block diagram of a light-emitting circuit in accordance with an embodiment of the present disclosure. As shown in FIG. 1, the light-emitting circuit 100 includes an input circuit 110, a storage circuit 120, a driving circuit 130, and a light-emitting unit 140. The input circuit 110, according to the scan signal SCN, provides the data signal DT to the storage circuit 120 for storage, which is configured to control the driving circuit 130. The driving circuit 130 generates an appropriate driving current ID according to the data signal DT, and supplies the driving current ID to the light-emitting unit 140 according to the light-emitting signal EM, so that the light-emitting unit 140 generates different luminance (i.e., different grayscale values) according to the magnitude of the driving current ID.

According to an embodiment of the present disclosure, when the light-emitting unit 140 is operated in the dark state, since the driving circuit 130 is too large, a leakage current IL is generated during the driving circuit 130 being turned off, so that the light-emitting unit 140 still illuminates according to the leakage current IL even in the dark state. As shown in FIG. 1, the light-emitting circuit 100 further includes a bypass circuit 150. The bypass circuit 150 diverts the leakage current IL according to the data signal DT to reduce the leakage current IL flowing through the light-emitting unit 140. Therefore, when the light-emitting unit 140 operates in the dark state, the bypass circuit 150 diverts the leakage current IL of the driving circuit 130, thereby reducing the possibility of the light-emitting unit 140 illuminating to improve the display quality.

Figure 2:
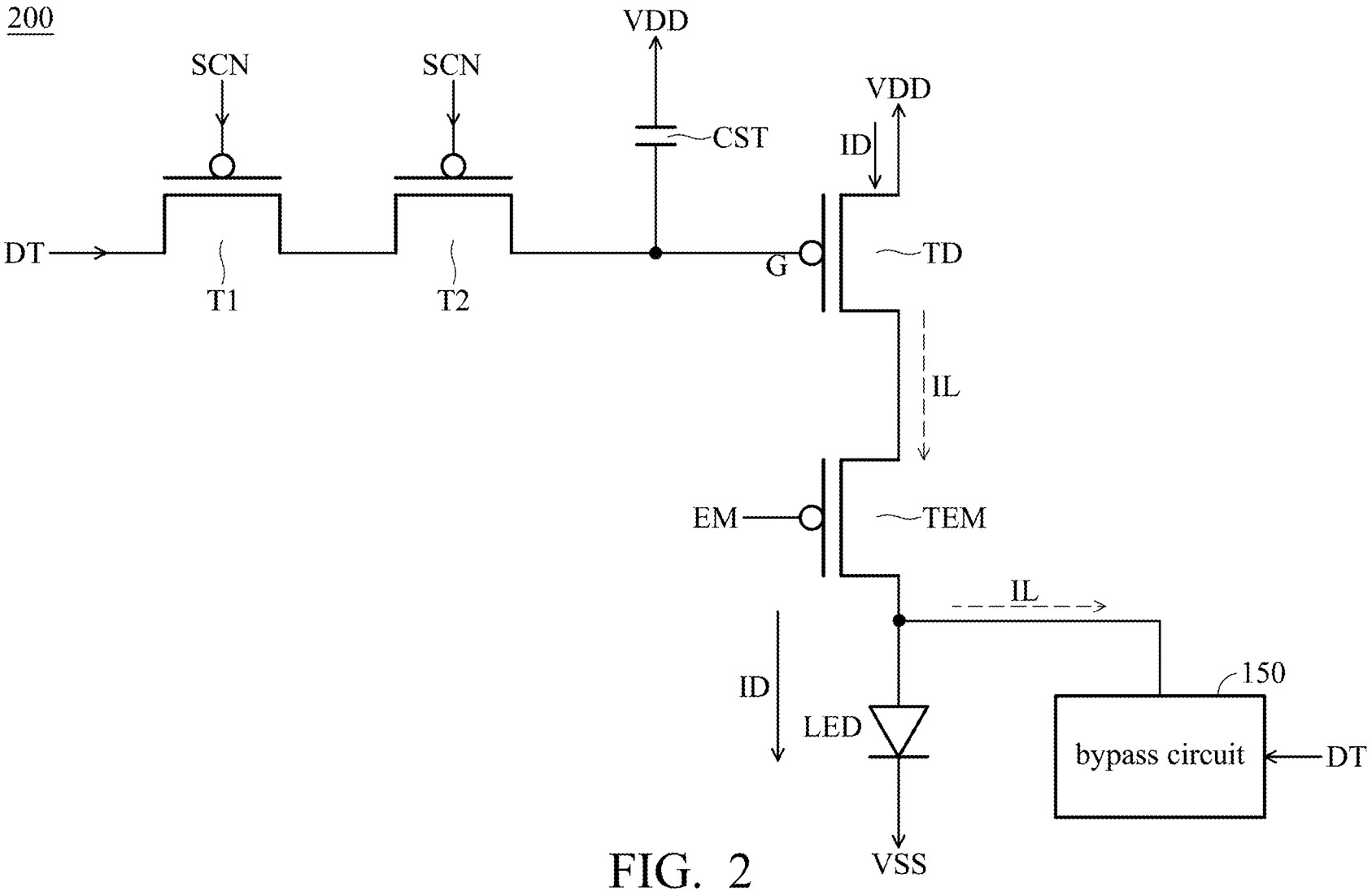
FIG. 2 is a schematic diagram of a light-emitting circuit in accordance with an embodiment of the present disclosure.

FIG. 2 is a schematic diagram of a light-emitting circuit in accordance with an embodiment of the present disclosure. As shown in FIG. 2, the light-emitting circuit 200 is powered by a supply voltage VDD and a ground voltage VSS, and includes a first switch transistor T1, a second switch transistor T2, a storage capacitor CST, a driving transistor TD, a light-emitting transistor TEM, and a light-emitting unit LED, in which the first switch transistor T1 and the second switch transistor T2 correspond to the input circuit 110 in FIG. 1, and the storage capacitor CST corresponds to the storage circuit 120 in FIG. 1. The driving transistor TD and The light-emitting transistor TEM corresponds to the driving circuit 130 in FIG. 1, and the light-emitting unit LED corresponds to the light-emitting unit 140 in FIG. 1.

According to an embodiment of the present disclosure, when the scan signal SCN is at a low logic level, the data signal DT is provided to the gate terminal G of the driving transistor TD, and the storage capacitor CST is configured to store the data provided to the gate terminal G The potential of the data signal DT. The driving transistor TD generates a driving current ID according to the voltage level of the data signal DT of the gate terminal G. When the light-emitting signal EM is at a low logic level, the light-emitting transistor TEM is turned on, and the light-emitting unit LED then generates corresponding luminance according to the driving current ID. In other words, the data signal DT is configured to control the illuminance generated by the light-emitting unit LED (that is, the gray scale value of the light-emitting unit LED), and the light-emitting signal EM is configured to control whether the light-emitting unit LED is lit.

According to some embodiments of the present disclosure, the light-emitting unit LED may include liquid crystal (LC), organic light-emitting diode (OLED), mini light-emitting diode (Mini LED), micro light-emitting diode (micro LED), quantum dot light-emitting diode (QLED/QDLED), quantum dot (QD), fluorescent Light powder, fluorescent light or other light-emitting units, but not intended to be limited thereto.

As shown in the embodiment in FIG. 2, the storage capacitor CST is electrically connected between the supply voltage VDD and the gate terminal G. According to another embodiment of the present disclosure, the storage capacitor CST may also be electrically connected between the ground voltage VSS and the gate terminal G. According to other embodiments of the present disclosure, the storage capacitor CST may also be electrically connected between any reference voltage and the gate terminal G.

According to an embodiment of the present disclosure, when the light-emitting unit LED is operated in the dark state, although the driving transistor TD is turned off according to the data signal DT, the driving transistor TD still generates a leakage current IL. The bypass circuit 150 generates a bypass path according to the data signal DT prior to the light-emitting unit LED, and the impedance of the bypass path is less than the impedance of the light-emitting unit LED, so that the leakage current IL is expelled to the ground voltage VS S through the bypass circuit 150 and the illuminance of the unit LED is only controlled by the drive current ID.

Figure 3:
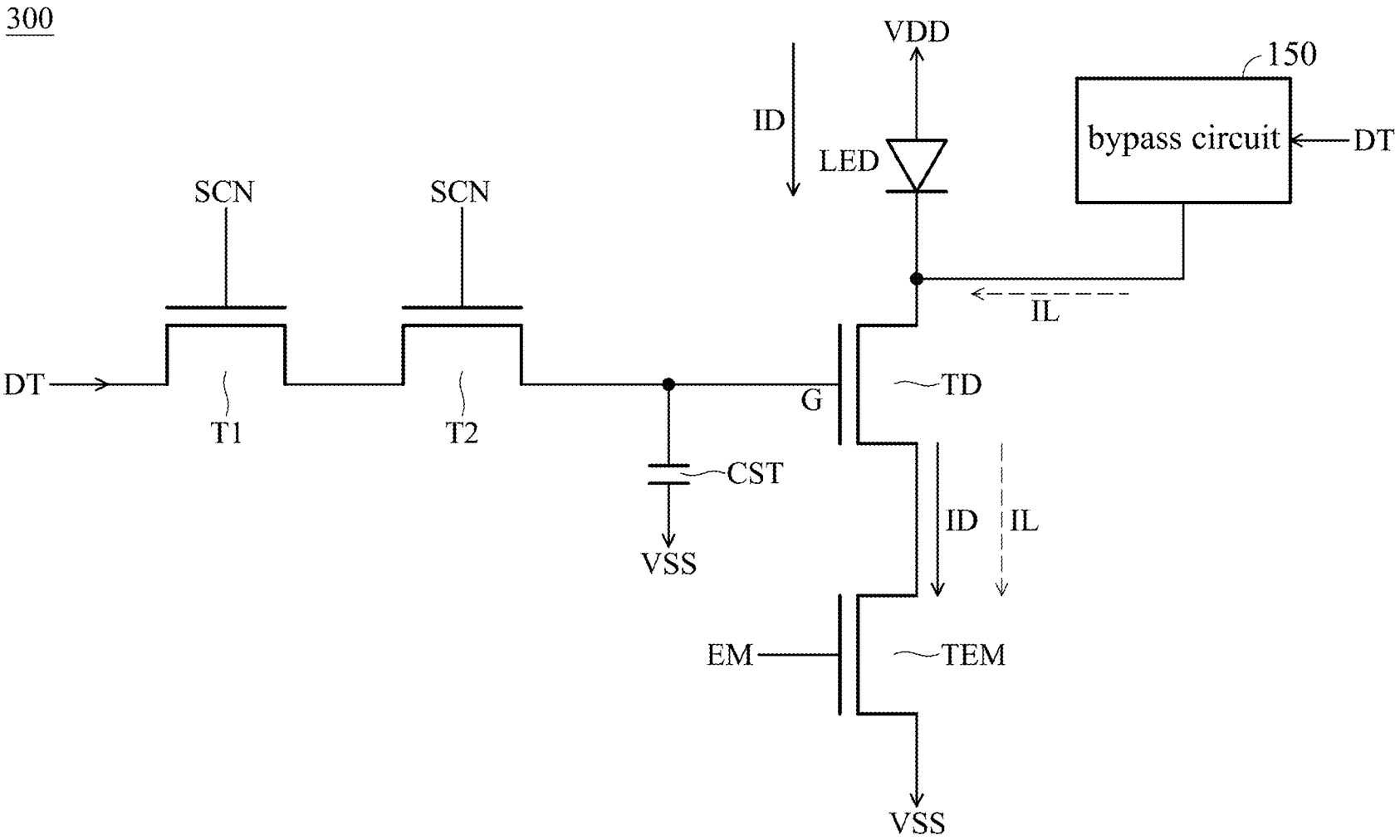
FIG. 3 is a schematic diagram of a light-emitting circuit in accordance with another embodiment of the present disclosure.

FIG. 3 is a schematic diagram of a light-emitting circuit in accordance with another embodiment of the present disclosure. As shown in FIG. 3, the light-emitting circuit 300 is implemented by N-type transistors. Therefore, in the operation of the light-emitting circuit 300, the logic levels of the scan signal SCN, the light-emitting signal EM, and the data signal DT are opposite to those in FIG. 2. As shown in FIG. 3, the storage capacitor CST is electrically connected between the gate terminal G and the ground voltage VSS. According to other embodiments of the present disclosure, the storage capacitor CST is electrically connected between the gate terminal G and the supply voltage VDD or any reference voltage. When the light-emitting unit LED operates in the dark state, the bypass circuit 150 generates a bypass path with a lower impedance next to the light-emitting unit LED according to the data signal DT so that the leakage current IL flows through the bypass path generated by the bypass circuit 150, thereby keeping the light-emitting unit LED in the dark state.

Figure 4:
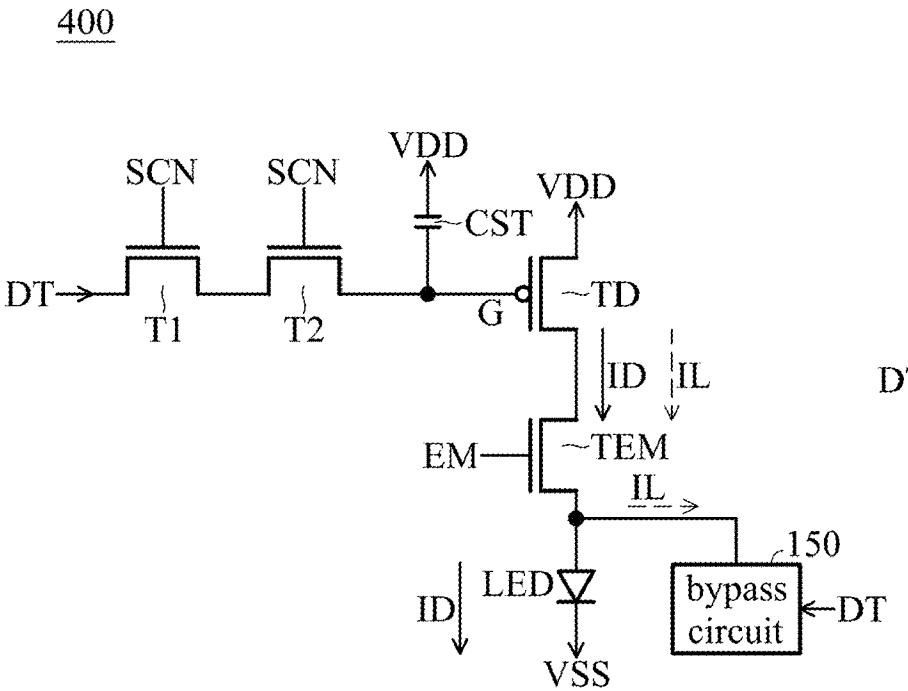
FIG. 4 is a schematic diagram of a light-emitting circuit in accordance with another embodiment of the present disclosure.

FIG. 4 is a schematic diagram of a light-emitting circuit in accordance with another embodiment of the present disclosure. As shown in FIG. 4, the first switch transistor T1, the second switch transistor T2, and the light-emitting transistor TEM of the light-emitting circuit 400 are N-type transistors, and the driving transistor TD of the light-emitting circuit 400 is a P-type transistor. The circuit operation of the light-emitting circuit 400 and the logic levels of the signals are similar to those of the light-emitting circuit 200 in FIG. 2 and those of the light-emitting circuit 300 in FIG. 3, and will not be repeated herein. As shown in FIG. 4, the storage capacitor CST is electrically connected between the gate terminal G and the supply voltage VDD. According to other embodiments of the present disclosure, the storage capacitor CST may also be electrically connected between the gate terminal G and the ground voltage VSS, or between the gate terminal G and any other reference voltage.

Figure 5:
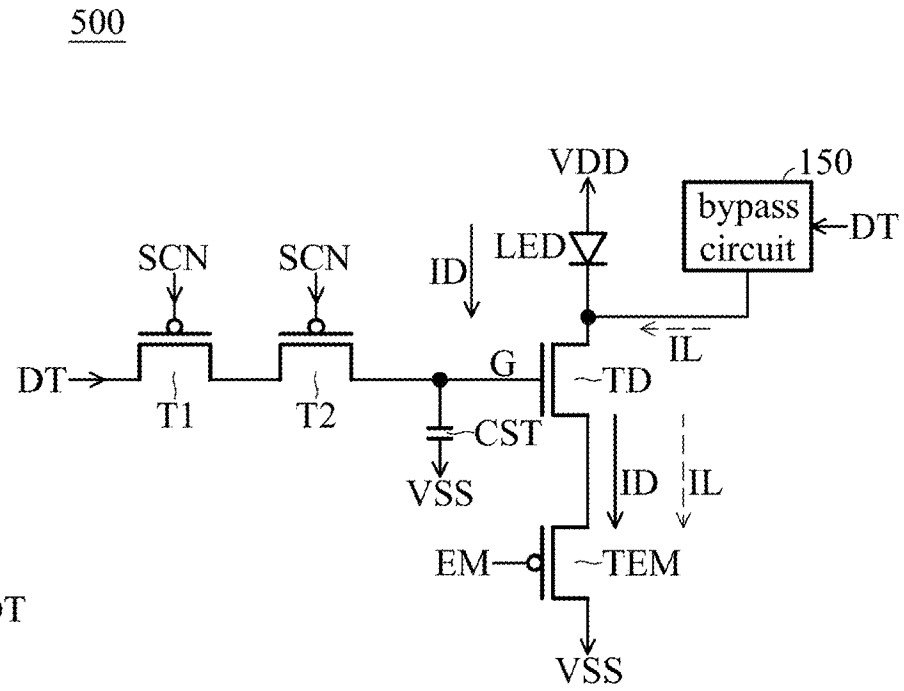
FIG. 5 is a schematic diagram of a light-emitting circuit in accordance with another embodiment of the present disclosure.

FIG. 5 is a schematic diagram of a light-emitting circuit in accordance with another embodiment of the present disclosure. As shown in FIG. 5, the first switch transistor T1, the second switch transistor T2, and the light-emitting transistor TEM of the light-emitting circuit 500 are P-type transistors, and the driving transistor TD of the light-emitting circuit 500 is an N-type transistor. The operation of the light-emitting circuit 500 and the logic levels of the signals are similar to those of the light-emitting circuit 200 in FIG. 2 and those of the light-emitting circuit 300 in FIG. 3, and will not be repeated herein. As shown in FIG. 5, the storage capacitor CST is electrically connected between the gate terminal G and the ground voltage VSS. According to other embodiments of the present disclosure, the storage capacitor CST can also be electrically connected between the gate terminal G and the supply voltage VDD, or between the gate terminal G and any other reference voltage.

As stated above, the light-emitting circuit may be implemented by P-type transistors, by N-type transistors, or by a combination of P-type transistors and N-type transistors. The bypass circuit 150 is required to be electrically connected to the supply voltage VDD or the ground voltage VSS, and each signal is required to have its trigger logic level adjusted accordingly. In order to simplify the explanation, the following description of the bypass circuit will take the light-emitting circuit 200 in FIG. 2 as an illustration, and the present disclosure is not intended to be limited thereto. In addition, those skilled in the art would, with simple corrections and modifications, directly apply the concept of the bypass circuit of the light-emitting circuit 200 to the light-emitting circuit 300 of FIG. 3 implemented by only N-type transistors or the light-emitting circuit 400 in FIG. 4 and the light-emitting circuit 500 in FIG. 5 implemented by mixed P-type transistors and N-type transistors.

Figure 6B:
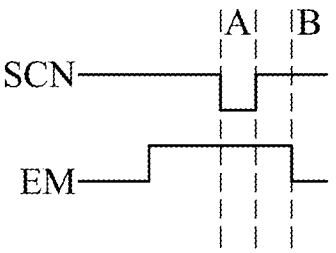
FIG. 6B is a timing diagram of the light-emitting circuit in FIG. 6A of the present disclosure.
Figure 6A:
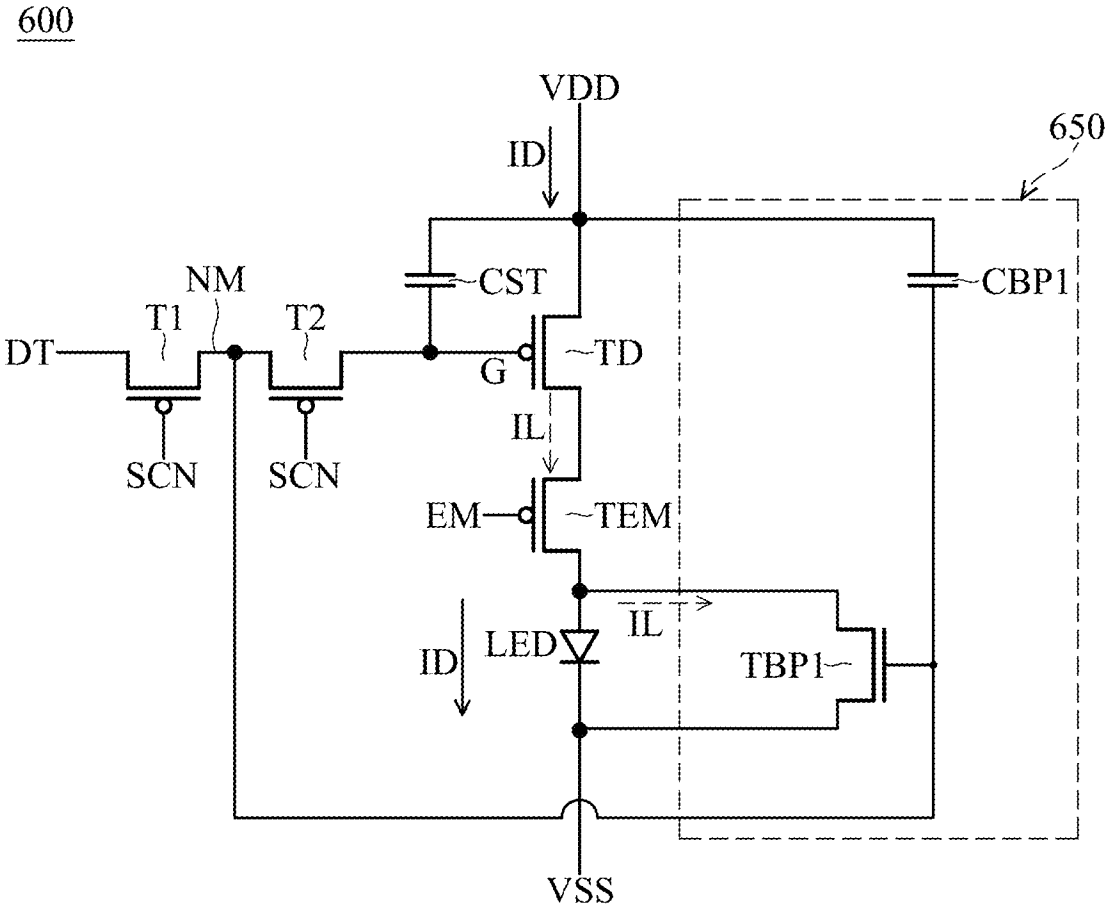
FIG. 6A is a schematic diagram of a light-emitting circuit in accordance with an embodiment of the present disclosure.

FIG. 6A is a schematic diagram of a light-emitting circuit in accordance with an embodiment of the present disclosure. As shown in FIG. 6A, the light-emitting circuit 600 includes a bypass circuit 650, in which the bypass circuit 650 includes a first bypass transistor TBP1 and a first bypass capacitor CBP1. One terminal of the first bypass transistor TBP1 is electrically connected to the node between the light-emitting transistor TEM and the light-emitting unit LED, and the other terminal of the first bypass transistor TBP1 is electrically connected to the node between the light-emitting unit LED and the ground voltage VSS. The gate terminal of the first bypass transistor TBP1 is electrically connected to the intermediate node NM between the first switch transistor T1 and the second switch transistor T2 for receiving the data signal DT.

As shown in FIG. 6A, the first bypass capacitor CBP1 is electrically connected between the supply voltage VDD and the gate terminal of the first bypass transistor TBP1. According to another embodiment of the present disclosure, the first bypass capacitor CBP1 may also be electrically connected between the ground voltage VSS and the gate terminal of the first bypass transistor TBP1. According to other embodiments of the present disclosure, the first bypass capacitor CBP1 may also be electrically connected between any reference voltage and the gate terminal of the first bypass transistor TBP1.

FIG. 6B is a timing diagram of the light-emitting circuit in FIG. 6A of the present disclosure. According to an embodiment of the present disclosure, when the light-emitting circuit 600 is operated in the first state A (data-written state) in FIG. 6B, the scan signal SCN is at the low logic level, and the light-emitting signal EM is at the high logic level. Therefore, the first switch transistor T1 and the second switch transistor T2 are turned on based on the scan signal SCN at the low logic level, and the light-emitting transistor TEM is turned off based on the light signal EM at the high logic level. When the first switch transistor T1 and the second switch transistor T2 are turned on, the data signal DT is provided to the intermediate node NM and the gate terminal G, and the first bypass capacitor CBP1 stores the data signal DT provided to the intermediate node NM.

According to the embodiment of the present disclosure, when the light-emitting circuit 600 is operated in the second state B (display state) of FIG. 6B, the scan signal SCN is at the high logic level, and the light-emitting signal EM is at the low logic level. Therefore, the first switch transistor T1 and the second switch transistor T2 are turned off based on the scanning signal SCN at the high logic level, and the light-emitting transistor TEM is turned on based on the light signal EM at the low logic level. The first bypass transistor TBP1 is an N-type transistor, and the first bypass transistor TBP1 determines its conduction level based on the data signal DT of the intermediate node NM stored in the first bypass capacitor CBP1. The greater the drive current ID, the lower the conduction level of the first bypass transistor TBP1. The lower the driving current ID, the higher the conduction level of the first bypass transistor TBP1. The leakage current may be expelled to the ground VSS through the bypass circuit, thereby reducing the possibility of the leakage current flowing through the light-emitting unit LED to reduce the possibility of the light-emitting unit LED illuminating in the dark state.

Figure 7B:
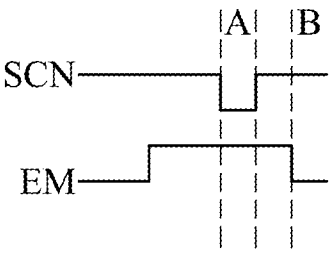
FIG. 7B is a timing diagram of the light-emitting circuit in FIG. 7A of the present disclosure.
Figure 7A:
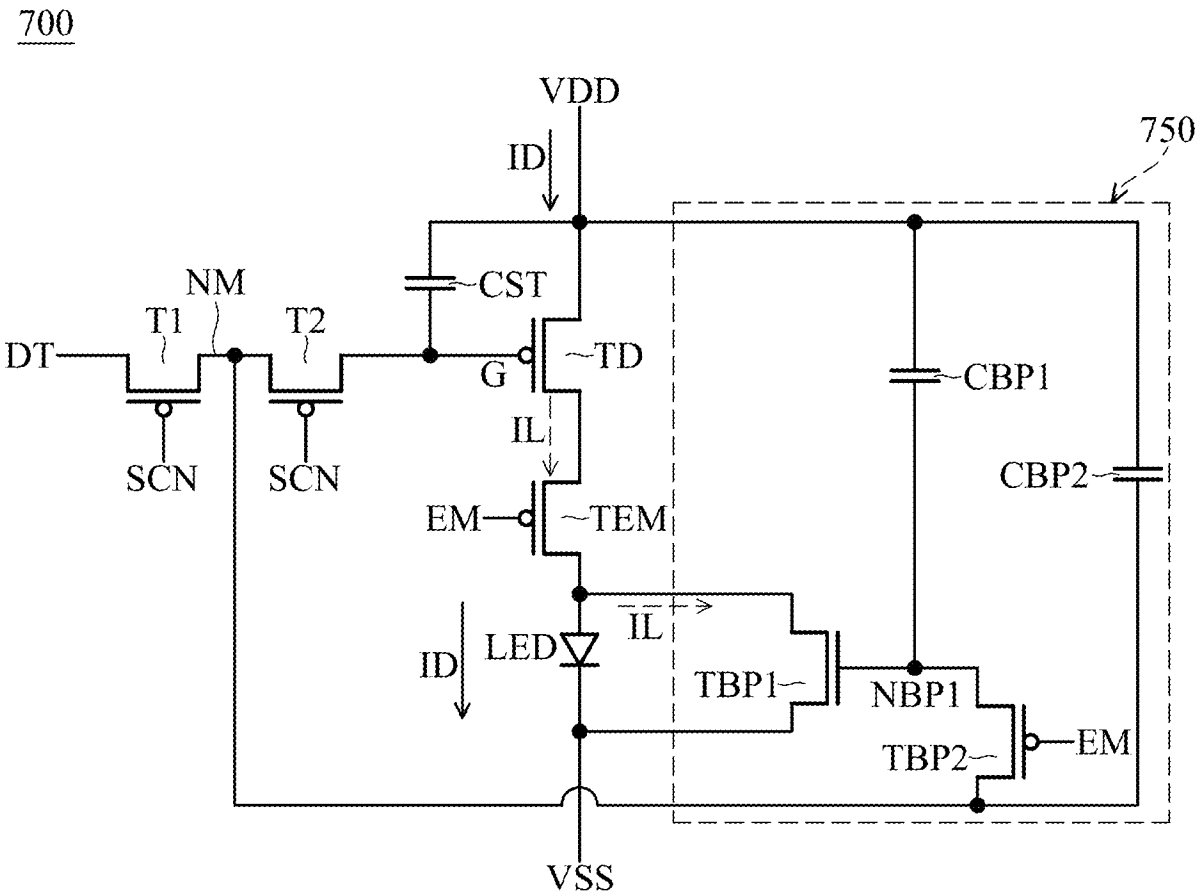
FIG. 7A is a schematic diagram of a light-emitting circuit in accordance with another embodiment of the present disclosure.

FIG. 7A is a schematic diagram of a light-emitting circuit in accordance with another embodiment of the present disclosure. As shown in FIG. 7A, the light-emitting circuit 700 includes a bypass circuit 750, in which the bypass circuit 750 includes a first bypass transistor TBP1, a first bypass capacitor CBP1, a second bypass transistor TBP2, and a second bypass capacitor CBP2. The first bypass transistor TBP1 is an N-type transistor. One terminal of the first bypass transistor TBP1 is electrically connected to the node between the light-emitting transistor TEM and the light-emitting unit LED, the other terminal of the first bypass transistor TBP1 is electrically connected to the node between the light-emitting unit LED and the ground voltage VSS, and the gate terminal of the first bypass transistor TBP1 is electrically connected to the first bypass node NBP1. The second bypass transistor TBP2 is electrically connected between the intermediate node NM and the first bypass node NBP1, and the gate terminal of the second bypass transistor TBP2 receives the light-emitting signal EM. As shown in FIG. 7A, the first bypass capacitor CBP1 is the same as the first bypass current CBP1 in FIG. 6A, and will not be repeated herein. The second bypass capacitor CBP2 is electrically connected between the intermediate node NM and the supply voltage VDD.

FIG. 7B is a timing diagram of the light-emitting circuit in FIG. 7A of the present disclosure. According to an embodiment of the present disclosure, when the light-emitting circuit 700 operates in the first state A of FIG. 7B, the scan signal SCN is at the low logic level, and the light-emitting signal EM is at the high logic level, so the first switch transistor T1 and the second switch transistor T2 are turned on based on the scan signal SCN at the low logic level and the light-emitting transistor TEM and the second bypass transistor TBP2 are turned off based on the light signal EM at the high logic level. When the first switch transistor T1 and the second switch transistor T2 are turned on, the data signal DT is provided to the intermediate node NM and the gate terminal G, and the second bypass capacitor CBP2 stores the data signal DT provided to the intermediate node NM.

According to the embodiment of the present disclosure, when the light-emitting circuit 700 is operated in the second state B of FIG. 7B, the scan signal SCN is at the high logic level and the light-emitting signal EM is at the low logic level, so the first switch transistor T1 and the second switch transistor T2 are turned off based on the scan signal SCN at the high logic level, and the light-emitting transistor TEM and the second bypass transistor TBP2 are turned on based on the light signal EM at the low logic level. Therefore, the second bypass transistor TBP2 provides the data signal DT stored in the second bypass capacitor CBP2 to the first bypass node NBP1, and the first bypass capacitor CBP1 stores the voltage provided to the first bypass node NBP1 (data signal). The first bypass transistor TBP1 determines its conduction level based on the voltage (data signal) stored in the first bypass capacitor CBP1. When the drive current ID is greater, the conduction level of the first bypass transistor TBP1 is lower; when the drive current ID is lower, the conduction level of the first bypass transistor TBP1 is higher. The leakage current IL may pass through the first bypass transistor TBP1 to the ground voltage VSS, thereby reducing the possibility of the leakage current IL flowing through the light-emitting unit LED to reduce the possibility of luminescence of the light-emitting unit LED in the dark state. In addition, the first bypass capacitor CBP1 may continuously turn on the first bypass transistor TBP1 to divert the leakage current IL after the second bypass transistor TBP2 is turned on and then turned off.

According to the embodiment of the present disclosure, when the second bypass transistor TBP2 is turned off, the first bypass node NBP1 is in a floating state.

Figure 8B:
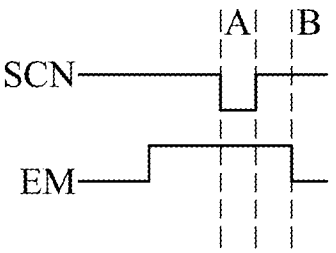
FIG. 8B is a timing diagram of the light-emitting circuit in FIG. 8A of the present disclosure.
Figure 8A:
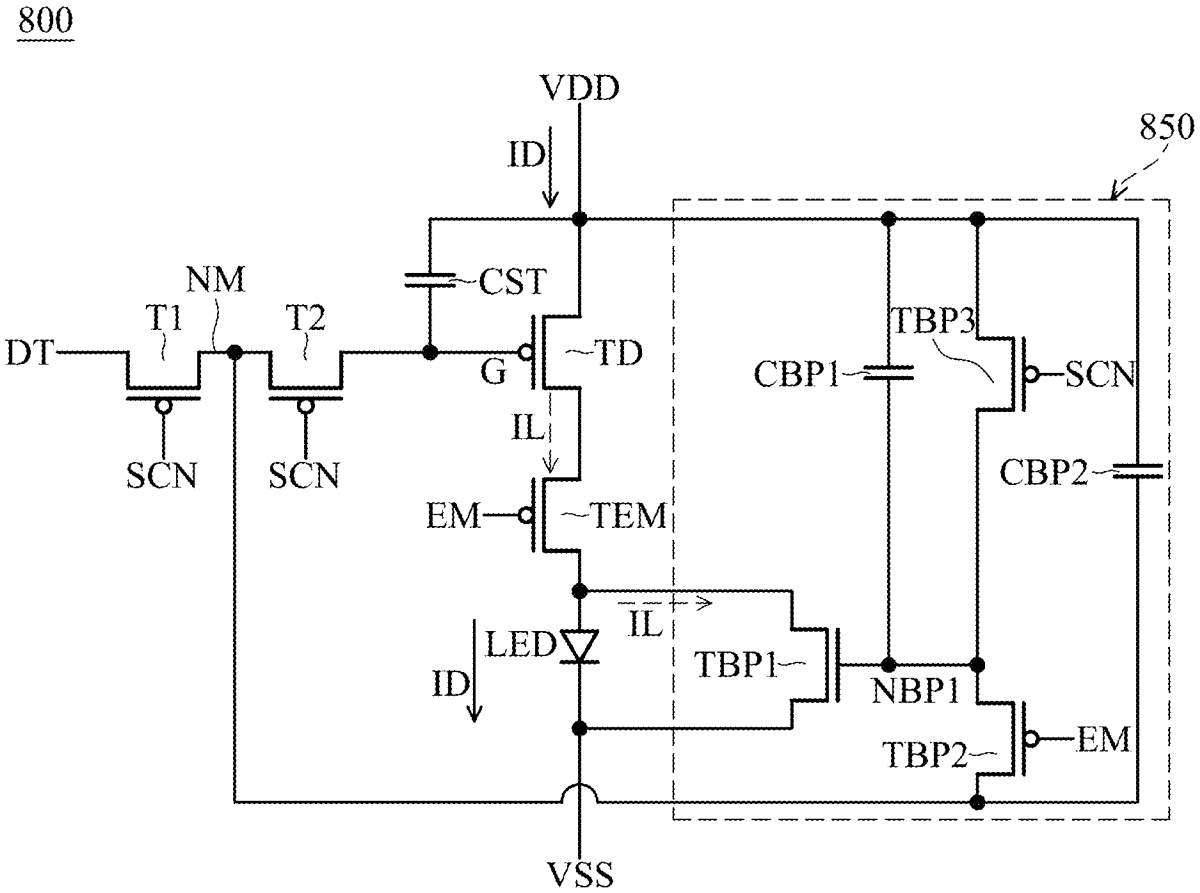
FIG. 8A is a schematic diagram of a light-emitting circuit in accordance with another embodiment of the present disclosure.

FIG. 8A is a schematic diagram of a light-emitting circuit in accordance with another embodiment of the present disclosure. As shown in FIG. 8A, the light-emitting circuit 800 includes a bypass circuit 850, in which the bypass circuit 850 includes a first bypass transistor TBP1, a first bypass capacitor CBP1, a second bypass transistor TBP2, a second bypass capacitor CBP2, and the third bypass transistor TBP3. The first bypass transistor TBP1 is an N-type transistor. One terminal of the first bypass transistor TBP1 is electrically connected to the node between the light-emitting transistor TEM and the light-emitting unit LED, the other terminal of the first bypass transistor TBP1 is electrically connected to the node between the light-emitting unit LED and the ground voltage VSS, and the gate terminal of the first bypass transistor TBP1 is electrically connected to the first bypass node NBP1.

As shown in FIG. 8A, the first bypass capacitor CBP1 is the same as the first bypass capacitor CBP1 in FIG. 6A, and will not be repeated herein. The second bypass transistor TBP2 is electrically connected between the intermediate node NM and the first bypass node NBP1, and the gate terminal of the second bypass transistor TBP2 receives the light-emitting signal EM. According to an embodiment of the present disclosure, as shown in FIG. 8A, the second bypass capacitor CBP2 is the same as the second bypass capacitor CBP2 in FIG. 7A, and will not be repeated herein.

The third bypass transistor TBP3 is electrically connected to the different terminals of the first bypass capacitor CBP1 (i.e., the first terminal and the second terminal), and the gate terminal of the third bypass transistor TBP3 receives the scan signal SCN to reset the voltage stored in the first bypass capacitor CBP1 based on the scanning signal SCN. As shown in FIG. 8A, the third bypass transistor TBP3 is electrically connected between the supply voltage VDD and the first bypass node NBP1. According to other embodiments of the present disclosure, when the first bypass capacitor CBP1 is electrically connected between any reference voltage and the first bypass node NBP1 or between the ground voltage VSS and the first bypass node NBP1, the third bypass transistor TBP3 is subsequently electrically connected between any reference voltage and the first bypass node NBP1 or between the ground voltage VSS and the first bypass node NBP1.

FIG. 8B is a timing diagram of the light-emitting circuit in FIG. 8A of the present disclosure. According to an embodiment of the present disclosure, when the light-emitting circuit 800 operates in the first state A in FIG. 8B, the scan signal SCN is at the low logic level and the light-emitting signal EM is at the high logic level, so the first switch transistor T1, the second switch transistor T2, and the third bypass transistor TBP3 are turned on based on the scan signal SCN at the low logic level, and the light-emitting transistor TEM and the second bypass transistor TBP2 are turned off based on the high logic level of the light signal EM. Therefore, the data signal DT is provided to the intermediate node NM and the gate terminal G via the first transistor T1 and the second transistor T2, the second bypass capacitor CBP2 stores the data signal DT provided to the intermediate node NM, and the third bypass transistor TBP3 resets the voltage stored in the first bypass capacitor CBP1. In other words, the third bypass transistor TBP3 provides the supply voltage VDD to the first bypass node NBP1, thereby reducing the possibility of voltage instability at the first bypass node NBP1 to improve the quality of the image presentation.

According to the embodiment of the present disclosure, when the light-emitting circuit 800 is operating in the second state B of FIG. 8B, the scan signal SCN is at the high logic level and the light-emitting signal EM is at the low logic level, so the first switch Transistor T1, second switch transistor T2, and third bypass transistor TBP3 are turned off based on the scan signal SCN at the high logic level, and the light-emitting transistor TEM and second bypass transistor TBP2 are turned on based on a low logic level light signal EM. Therefore, the second bypass transistor TBP2 provides the data signal DT of the intermediate node NM stored in the second bypass capacitor CBP2 to the first bypass node NBP1, and the first bypass capacitor CBP1 stores the data signal DT provided to the first bypass node NBP1. The first bypass transistor TBP1 determines its conduction level based on the voltage (data signal) stored in the first bypass capacitor CBP1. When the drive current ID is larger, the conduction level of the first bypass transistor TBP1 is lower; when the drive current ID is lower, the conduction level of the first bypass transistor TBP1 is higher. The leakage current IL may pass through the first bypass transistor TBP1 to the ground voltage VSS, thereby reducing the possibility of the leakage current IL flowing through the light-emitting unit LED to reduce the possibility of the light-emitting unit LED illuminating in the dark state.

Figure 9B:
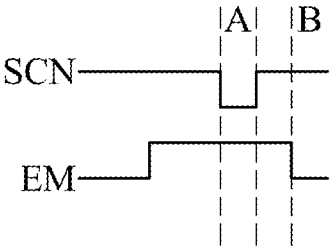
FIG. 9B is a timing diagram of the light-emitting circuit in FIG. 9A of the present disclosure.
Figure 9A:
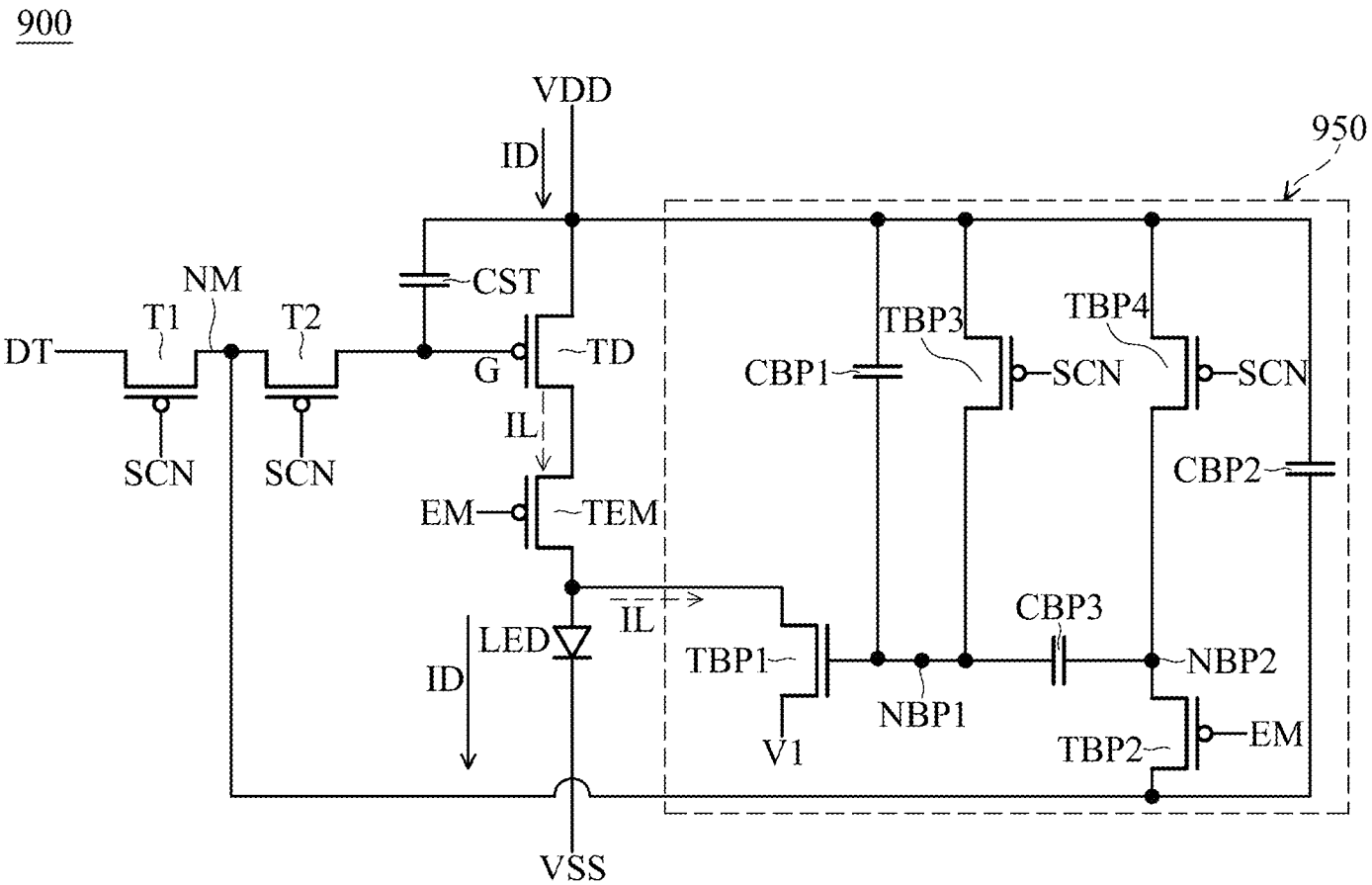
FIG. 9A is a schematic diagram of a light-emitting circuit in accordance with another embodiment of the present disclosure.

FIG. 9A is a schematic diagram of a light-emitting circuit in accordance with another embodiment of the present disclosure. As shown in FIG. 9A, the light-emitting circuit 900 includes a bypass circuit 950, in which the bypass circuit 950 includes a first bypass transistor TBP1, a first bypass capacitor CBP1, a second bypass transistor TBP2, a second bypass capacitor CBP2, a third bypass transistor TBP3, a third bypass capacitor CBP3, and a fourth bypass transistor TBP4. The first bypass transistor TBP1 is an N-type transistor. One terminal of the first bypass transistor TBP1 is electrically connected to the node between the light-emitting transistor TEM and the light-emitting unit LED, the other terminal of the first bypass transistor TBP1 is electrically connected to a first voltage V1, and the gate terminal of the first bypass transistor TBP1 is electrically connected to the first bypass node NBP1. According to some embodiments of the present disclosure, the first voltage V1 is not greater than the ground voltage VSS. That is, the first voltage V1 is less than or equal to the ground voltage VSS.

As shown in FIG. 9A, the first bypass capacitor CBP1 is the same as the first bypass capacitor CBP1 in FIG. 6A, and will not be repeated herein. The second bypass transistor TBP2 is electrically connected between the intermediate node NM and the second bypass node NBP2, and the gate terminal of the second bypass transistor TBP2 receives the light-emitting signal EM. According to an embodiment of the present disclosure, as shown in FIG. 9A, the second bypass capacitor CBP2 is the same as the second bypass capacitor CBP2 in FIG. 7A, and will not be repeated herein.

The third bypass transistor TBP3 is electrically connected to the different terminals of the first bypass capacitor CBP1, and the gate terminal of the third bypass transistor TBP3 receives the scanning signal SCN to reset the voltage stored in the first bypass capacitor CBP1 based on the scanning signal SCN. As shown in FIG. 9A, the third bypass transistor TBP3 is electrically connected between the supply voltage VDD and the first bypass node NBP1. According to other embodiments of the present disclosure, when the first bypass capacitor CBP1 is electrically connected between any reference voltage and the first bypass node NBP1 or between the ground voltage VSS and the first bypass node NBP1, the third bypass transistor TBP3 is thus electrically connected between any reference voltage and the first bypass node NBP1 or between the ground voltage VSS and the first bypass node NBP1.

As shown in FIG. 9A, the third bypass capacitor CBP3 is electrically connected between the first bypass node NBP1 and the second bypass node NBP2, the fourth bypass transistor TBP4 is electrically connected between the supply voltage VDD and the second bypass node NBP2, and the gate terminal of the fourth bypass transistor TBP4 receives the scan signal SCN to reset the voltage of the second bypass node NBP2 based on the scan signal SCN.

FIG. 9B is a timing diagram of the light-emitting circuit in FIG. 9A of the present disclosure. According to an embodiment of the present disclosure, when the light-emitting circuit 900 operates in the first state A of FIG. 9B, the scan signal SCN is at the low logic level and the light-emitting signal EM is at the high logic level, so that the first switch transistor T1, the second switch transistor T2, the third bypass transistor TBP3, and the fourth bypass transistor TBP4 are turned on based on the scan signal SCN at the low logic level and the light-emitting transistor TEM and the second bypass transistor TBP2 are turned off based on the light-emitting signal EM at the high logic level. Therefore, the data signal DT is provided to the intermediate node NM and the gate terminal G through the first switch transistor T1, the second switch transistor T2, and the second bypass capacitor CBP2 stores the data signal DT provided to the intermediate node NM, the third bypass transistor TBP3 resets the voltage stored in the first bypass capacitor CBP1 to turn off the first bypass transistor TBP1, and the fourth transistor TBP4 resets the voltage of the second bypass node NBP2.

According to another embodiment of the present disclosure, when the light-emitting circuit 800 is operating in the second state B of FIG. 9B, the scan signal SCN is at the high logic level, and the light-emitting signal EM is at the low logic level, so that the first switch transistor T1, a second switch transistor T2, a third bypass transistor TBP3, and a fourth bypass transistor TBP4 are turned off based on the scan signal SCN at the high logic level, the light-emitting transistor TEM and the second bypass transistor TBP2 are turned on based on the light-emitting signal EM at the low logic level. Therefore, the second bypass transistor TBP2 provides the data signal DT at the intermediate node NM to the second bypass node NBP2, and the voltage variation of the second bypass node NBP2 is transmitted to the first bypass node NBP1 through the coupling effect of the third bypass capacitor CBP3. In addition, the first bypass capacitor CBP1 stores the data signal DT provided to the first bypass node NBP1, the first bypass transistor TBP1 generates a bypass path next to the light-emitting unit LED based on the data signal DT of the first bypass node NBP1 stored in the first bypass capacitor CBP1, thereby reducing the ratio of the driving current ID flowing through the light-emitting unit LED.

For example, taking FIG. 9A as an example, when the second bypass transistor TBP2 provides the data signal DT to the second bypass node NBP2, a voltage variation of (DT-VDD) is occurred at the second bypass node NBP2, and the voltage variation of (DT-VDD) is superimposed to the first bypass node NBP1 through the coupling effect of the third bypass capacitor CBP3. Therefore, the voltage of the first bypass node NBP1 becomes (VDD+(DT-VDD)=DT), and the data signal DT is provided to the first bypass node NBP1 through the coupling effect of the third bypass capacitor CBP3. Since cannot completely couple the voltage variation may not be fully coupled from one node to another node by the coupling effect, the above description is illustrated only for explanation but not intended to be limited thereto.

Figure 10B:
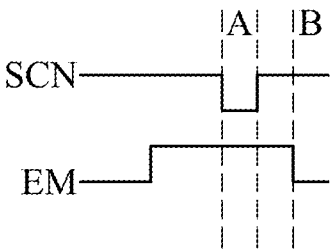
FIG. 10B is a timing diagram of the light-emitting circuit in FIG. 10A of the present disclosure.
Figure 10A:
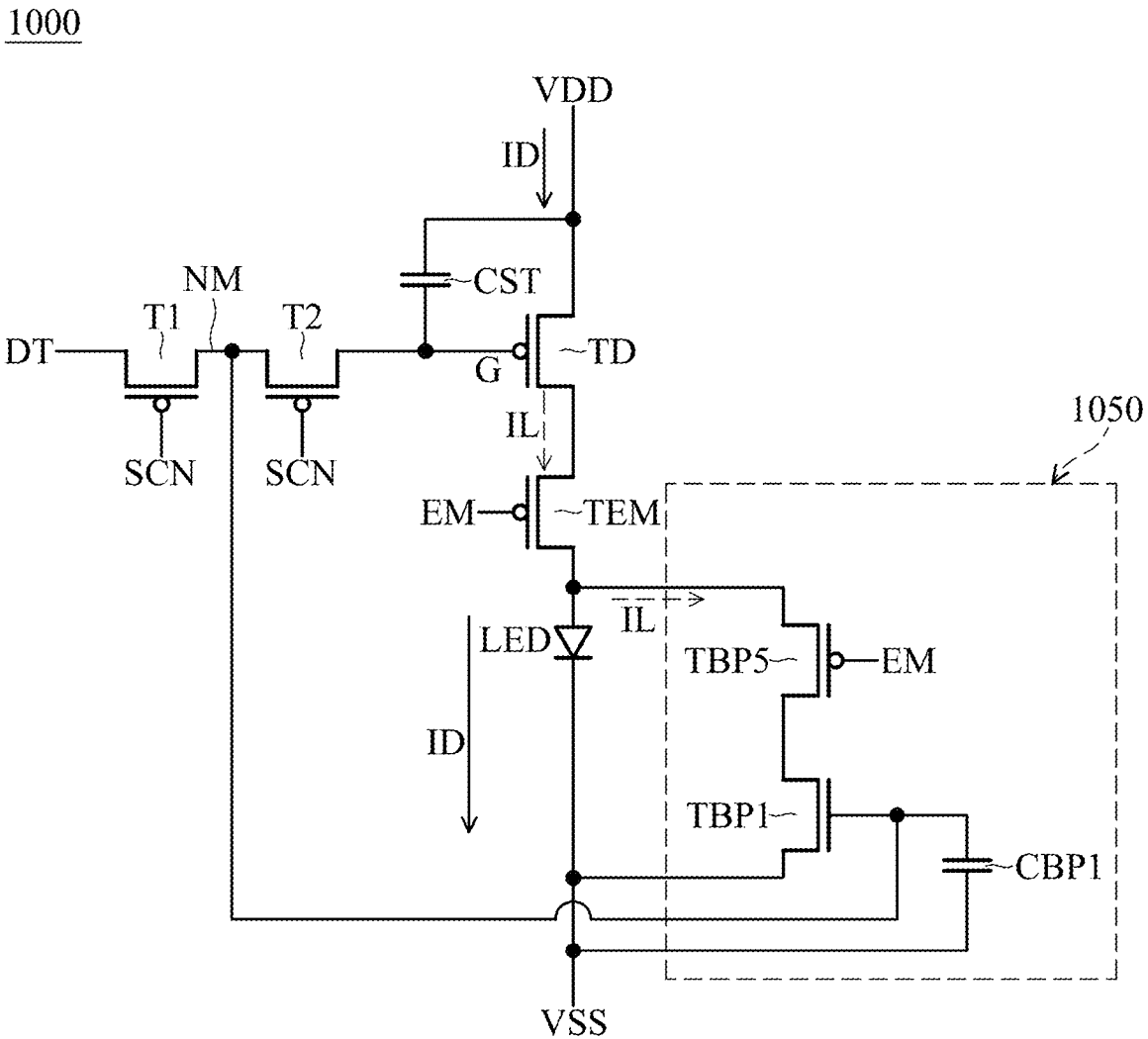
FIG. 10A is a schematic diagram of a light-emitting circuit in accordance with another embodiment of the present disclosure.

FIG. 10A is a schematic diagram of a light-emitting circuit in accordance with another embodiment of the present disclosure. As shown in FIG. 10A, the light-emitting circuit 1000 includes a bypass circuit 1050, in which the bypass circuit 1050 includes a first bypass transistor TBP1, a fifth bypass transistor TBP5, and a first bypass capacitor CBP1. The first bypass transistor TBP1 is an N-type transistor. The first bypass transistor TBP1 is electrically connected between the ground voltage VSS and the fifth bypass transistor TBP5. The gate terminal of the first bypass transistor TBP1 is electrically connected to the intermediate node NM. One terminal of the fifth bypass transistor TBP5 is electrically connected to the node between the light-emitting transistor TEM and the light-emitting unit LED, the other terminal of the fifth bypass transistor TBP5 is electrically connected to the first bypass transistor TBP1, and the gate terminal of the fifth bypass transistor TBP5 receives the light-emitting signal EM. As shown in FIG. 10A, the first bypass capacitor CBP1 is the same as the first bypass current CBP1 in FIG. 6A, and will not be repeated herein.

FIG. 10B is a timing diagram of the light-emitting circuit in FIG. 10A of the present disclosure. According to an embodiment of the present disclosure, when the light-emitting circuit 1000 operates in the first state A in FIG. 10B, the scan signal SCN is at a low logic level, and the light-emitting signal EM is at a high logic level, so the first switch transistor T1 and the second switch transistor T2 are turned on based on the scan signal SCN of the low logic level, and the light-emitting transistor TEM and the fifth bypass transistor TBP5 are not turned on based on the light signal EM of the high logic level. Therefore, the data signal DT is provided to the intermediate node NM and the gate terminal G via the first switch transistor T1 and the second switch transistor T2, and the first bypass capacitor CBP1 stores the data signal DT provided to the intermediate node NM.

According to the embodiment of the present disclosure, when the light-emitting circuit 1000 operates in the second state B of FIG. 10B, the scan signal SCN is at the high logic level, the light-emitting signal EM is at the low logic level, and the first switch transistor T1 and the second switch transistor T2 are turned off based on the scan signal SCN at the high logic level, and the light-emitting transistor TEM and the fifth bypass transistor TBP5 are turned on based on the light signal EM at the low logic level. Therefore, the first bypass transistor TBP1 generates a bypass path next to the light-emitting unit LED based on the data signal DT of the intermediate node NM stored in the first bypass capacitor CBP1, thereby reducing the ratio of the driving current ID flowing through the light-emitting unit LED.

Figure 11B:
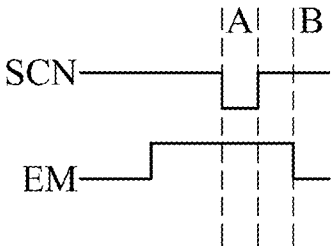
FIG. 11B is a timing diagram of the light-emitting circuit in FIG. 11A of the present disclosure.
Figure 11A:
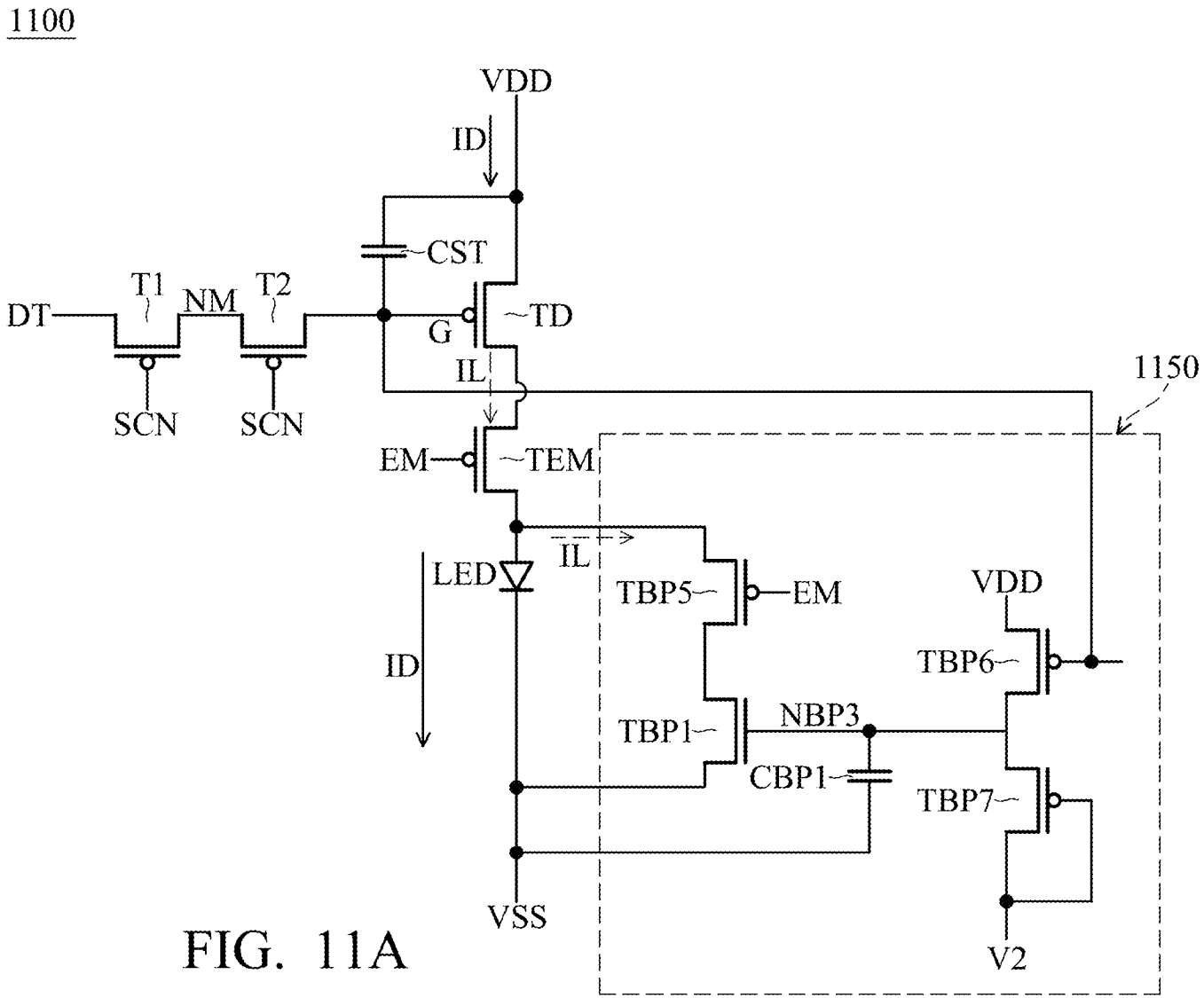
FIG. 11A is a schematic diagram of a light-emitting circuit in accordance with another embodiment of the present disclosure.

FIG. 11A is a schematic diagram of a light-emitting circuit in accordance with another embodiment of the present disclosure. As shown in FIG. 11A, the light-emitting circuit 1100 includes a bypass circuit 1150, in which the bypass circuit 1150 includes a first bypass transistor TBP1, a fifth bypass transistor TBP5, a first bypass capacitor CBP1, a sixth bypass transistor TBP6, and a seventh bypass transistor TBP7. The first bypass transistor TBP1 and the fifth bypass transistor TBP5 are connected in series between the node between the light-emitting transistor TEM and the light-emitting unit LED and the ground voltage VSS. The first bypass transistor TBP1 is an N-type transistor. The gate terminal of a bypass transistor TBP1 is electrically connected to the third bypass node NBP3, and the gate terminal of the fifth bypass transistor TBP5 receives the light-emitting signal EM.

As shown in FIG. 11A, the first bypass capacitor CBP1 is electrically connected between the ground voltage VSS and the third bypass node NBP3. According to another embodiment of the present disclosure, the first bypass capacitor CBP1 may also be electrically connected between the supply voltage VDD and the third bypass node NBP3. According to other embodiments of the present disclosure, the first bypass capacitor CBP1 can also be electrically connected between any reference voltage and the third bypass node NBP3.

The sixth bypass transistor TBP6 is electrically connected between the supply voltage VDD and the third bypass node NBP3, and the gate terminal of the sixth bypass transistor TBP6 is electrically connected to the gate terminal G. The seventh bypass transistor TBP7 is electrically connected between the third bypass node NBP3 and the second voltage V2, and the gate terminal of the seventh bypass transistor TBP7 receives the second voltage V2. In other words, the seventh bypass transistor TBP7 is electrically connected in the form of a diode, and is electrically connected between the third bypass node NBP3 and the second voltage V2. According to an embodiment of the present disclosure, the sixth bypass transistor TBP6 and the seventh bypass transistor TBP7 are configured as an inverter.

FIG. 11B is a timing diagram of the light-emitting circuit in FIG. 11A of the present disclosure. According to an embodiment of the present disclosure, when the light-emitting circuit 1100 is operating in the first state A of FIG. 11B, the scan signal SCN is at the low logic level, and the light-emitting signal EM is at the high logic level. Therefore, the first switch transistor T1 and the second switch transistor T2 are turned on based on the scan signal SCN of the low logic level, and the light-emitting transistor TEM and the fifth bypass transistor TBP5 are turned off based on the light signal EM of the high logic level. Therefore, the data signal DT is provided to the intermediate node NM and the gate terminal G through the first switch transistor T1 and the second switch transistor T2. The sixth bypass transistor TBP6 and the seventh bypass transistor TBP7 act as an inverter, which generate the voltage of the third bypass node NBP3 based on the voltage of the gate terminal G. In addition, the first bypass capacitor CBP1 stores the voltage of the third bypass node NBP3.

For example, when the data signal DT is transmitted to the gate terminal G so that the gate terminal G is at the supply voltage VDD, the seventh bypass transistor TBP7 pulls down the voltage of the third bypass node NBP3 to the second voltage V2. When the gate terminal G is at the ground voltage VSS, the sixth bypass transistor TBP6 pulls up the voltage of the third bypass node NBP3 to the supply voltage VDD. According to an embodiment of the present disclosure, the second voltage V2 is not larger than the ground voltage VSS. Therefore, the inverter formed by the sixth bypass transistor TBP6 and the seventh bypass transistor TBP7 may generate the voltage of the three bypass node NBP3 based on the voltage of the gate terminal G at any time. According to another embodiment of the present disclosure, the second voltage V2 can also be the scan signal SCN, so that the inverter formed by the sixth bypass transistor TBP6 and the seventh bypass transistor TBP7 operates only when the data signal DT is provided to the intermediate node NM and the gate terminal G (that is, the scan signal SCN is at a low logic level).

In other words, when the driving transistor TD generates the maximum driving current ID, the first bypass transistor TBP1 is turned off. When the driving transistor TD does not output the driving current ID, the first bypass transistor TBP1 is completely turned on. Therefore, when the maximum driving current ID is generated to operate the light-emitting unit LED at the brightest, the first bypass transistor TBP1 does not operate to reduce power loss. When the driving current ID is not output to operate the light-emitting unit LED at the darkest, the first bypass transistor TBP1 is fully turned on, avoiding the light-emitting unit LED to illuminate.

According to an embodiment of the present disclosure, when the sixth bypass transistor TBP6 and the seventh bypass transistor TBP7 are configured as an inverter to generate the voltage of the third bypass node NBP3 according to the voltage of the gate terminal G, the light-emitting transistor TEM and the fifth bypass transistor TBP5 are turned off, so that the first bypass capacitor CBP1 is configured to store the voltage of the third bypass node NBP3 generated by the sixth bypass transistor TBP6 and the seventh bypass transistor TBP7 and the first bypass transistor TBP1 does not interfere with the voltage of the node between the light-emitting transistor TEM and the light-emitting unit LED.

According to an embodiment of the present disclosure, when the second voltage V2 is the scan signal SCN, the inverter formed by the sixth bypass transistor TBP6 and the seventh bypass transistor TBP7 operates only when the scan signal SCN is in the low logic level. Therefore, the data signal DT can be stored in the first bypass capacitor CBP1 in advance, thereby shortening the waiting time required for the light-emitting unit LED to light up.

According to another embodiment of the present disclosure, when the light-emitting circuit 1100 is operating in the second state B of FIG. 11B, the scan signal SCN is at the high logic level, the light-emitting signal EM is at the low logic level, the first switch transistor T1 and the second switch transistor T2 are turned off based on the scan signal SCN at the high logic level, and the light-emitting transistor TEM and the fifth bypass transistor TBP5 are turned on based on the light signal EM of the low logic level. Therefore, the first bypass transistor TBP1 generates a bypass path next to the light-emitting unit LED based on the voltage of the third bypass node NBP3 stored in the first bypass capacitor CBP1. According to an embodiment of the present disclosure, when the driving transistor TD generates the maximum driving current ID, the first bypass transistor TBP1 is turned off without generating a bypass path, thereby reducing power loss and increasing the luminance of the light-emitting unit LED. According to another embodiment of the present disclosure, when the driving transistor TD does not output the driving current ID, the first bypass transistor TBP1 is fully turned on so that the light-emitting unit LED does not illuminate.

The embodiments of the disclosure propose a light-emitting circuit with a bypass circuit. When the light-emitting unit is darker, the conduction level of the bypass circuit is higher, which reduces the possibility of the light-emitting unit glowing in the dark state due to the leakage current, thereby reducing power loss and/or increasing the luminance of the light-emitting unit.

Although some embodiments of the present disclosure and their advantages have been described in detail, it should be understood that various changes, substitutions and alterations can be made herein without departing from the spirit and scope of the present disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the present disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A light-emitting circuit, comprising:

a light-emitting unit;

a driving transistor, configured to drive the light-emitting unit; and a bypass circuit, electrically connected to a node between the light-emitting unit and the driving transistor, wherein the bypass circuit diverts a current flowing from the driving transistor to the light-emitting unit;

a light-emitting transistor, electrically connected between the light-emitting unit and the driving transistor, wherein the driving transistor generates a driving current and the light-emitting transistor provides the driving current to the light-emitting unit based on a light-emitting signal;

a first switch transistor, providing the data signal to an intermediate node based on a scan signal; and a second switch transistor, electrically connected between the intermediate node and a gate terminal of the driving transistor, wherein the second switch transistor provides the data signal of the intermediate node to the gate terminal of the driving transistor based on the scan signal so that the driving transistor generates the driving current based on the data signal, wherein when the driving transistor is turned off based on the data signal, the driving transistor generates a leakage current, wherein the bypass circuit diverts the leakage current flowing from the driving transistor to the light-emitting unit;

wherein the bypass circuit further comprises:

a first bypass transistor, electrically connected to a node between the light-emitting transistor and the light-emitting unit, wherein the gate terminal of the first bypass transistor is electrically connected to the intermediate node and the first bypass transistor diverts the leakage current based on the data signal;

a first bypass capacitor, electrically connected to the gate terminal of the first bypass transistor and storing the data signal received by the gate terminal of the first bypass transistor;

a second bypass transistor, electrically connected between the intermediate node and the gate terminal of the first bypass transistor, wherein the gate terminal of the second bypass transistor receives the light-emitting signal; and a second bypass capacitor, electrically connected to the intermediate node.

2. The light-emitting circuit as defined in claim 1, further comprising:

a storage capacitor, electrically connected to the gate terminal of the driving transistor and configured to store the data signal received by the gate terminal of the driving transistor.

3. The light-emitting circuit as defined in claim 1, wherein:

when the light-emitting transistor is turned off based on the light-emitting signal and the first switch transistor and the second transistor are turned on based on the scan signal, the data signal is provided to the gate terminal of the first bypass transistor through the first switch transistor and the first bypass capacitor stores the data signal;

when the light-emitting transistor is turned on based on the light-emitting signal and the first switch transistor and the second switch transistor is turned off based on the scan signal, the first bypass transistor diverts the leakage current based on the data signal stored in the first bypass transistor.

4. The light-emitting circuit as defined in claim 1, wherein:

when the light-emitting transistor and the second bypass transistor are turned off based on the light-emitting signal and the first switch transistor and the second switch transistor are turned on based on the scan signal, the data signal is provided to the intermediate node through the first switch transistor and the second bypass capacitor stores the data signal;

when the light-emitting transistor and the second bypass transistor are turned on based on the light-emitting signal and the first switch transistor and the second switch transistor are turned off based on the scan signal, the second bypass transistor provides the data signal stored in the second bypass capacitor to the gate terminal of the first bypass transistor so that the first bypass transistor diverts the leakage current, wherein the first bypass capacitor stores the data signal received by the gate terminal of the first bypass transistor.

5. The light-emitting circuit as defined in claim 1, wherein the bypass circuit further comprises:

a third bypass transistor, electrically connected to both terminals of the first bypass capacitor, wherein the third bypass transistor resets a voltage stored in the first bypass capacitor based on the scan signal.

6. The light-emitting circuit as defined in claim 5, wherein:

when the light-emitting transistor and the second bypass transistor are turned off based on the light-emitting signal and the first switch transistor, the second switch transistor, and the third bypass transistor are turned on based on the scan signal, the data signal is provided to the intermediate node through the first switch transistor, the second bypass capacitor stores the data signal of the intermediate node, and the third bypass transistor resets the voltage stored in the first bypass capacitor so that the first bypass transistor is turned off;

when the light-emitting transistor and the second bypass transistor are turned-on based on the light-emitting signal and the first switch transistor, the second switch transistor, and the third switch transistor are turned off based on the scan signal, the second bypass transistor provides the data signal stored in the second bypass capacitor to the gate terminal of the first bypass transistor so that the first bypass transistor diverts the leakage current.

7. The light-emitting circuit as defined in claim 5, wherein:

the other terminal of the first bypass capacitor, the other terminal of the second bypass capacitor, and the third bypass transistor are electrically connected to a reference voltage.

8. A light-emitting circuit, comprising:

a light-emitting unit a driving transistor, configured to drive the light-emitting unit a bypass circuit, electrically connected to a node between the light-emitting unit and the driving transistor, wherein the bypass circuit diverts a current flowing from the driving transistor to the light-emitting unit;

a light-emitting transistor, electrically connected between the light-emitting unit and the driving transistor, wherein the driving transistor generates a driving current and the light-emitting transistor provides the driving current to the light-emitting unit based on a light-emitting signal;

a first switch transistor, providing the data signal to an intermediate node based on a scan signal; and a second switch transistor, electrically connected between the intermediate node and a gate terminal of the driving transistor, wherein the second switch transistor provides the data signal of the intermediate node to the gate terminal of the driving transistor based on the scan signal so that the driving transistor generates the driving current based on the data signal, wherein when the driving transistor is turned off based on the data signal, the driving transistor generates a leakage current, wherein the bypass circuit diverts the leakage current flowing from the driving transistor to the light-emitting unit;

wherein the bypass circuit further comprises:

a first bypass transistor, electrically connected to a node between the light-emitting transistor and the light-emitting unit, wherein the gate terminal of the first bypass transistor is electrically connected to the intermediate node and the first bypass transistor diverts the leakage current based on the data signal;

a first bypass capacitor, electrically connected to the gate terminal of the first bypass transistor and storing the data signal received by the gate terminal of the first bypass transistor; and a fourth bypass transistor, electrically connected to a node between the light-emitting transistor and the light-emitting unit and electrically connected to the first bypass transistor, wherein the gate terminal of the fourth bypass transistor receives the light-emitting signal.

9. The light-emitting circuit as defined in claim 8, wherein:

when the light-emitting transistor and the fourth bypass transistor are turned off based on the light-emitting signal and the first switch transistor and the second switch transistor are turned on based on the scan signal, the data signal provided to the gate terminal of the first bypass transistor through the first switch transistor is stored in the first bypass capacitor;

when the light-emitting transistor and the fourth bypass transistor are turned on based on the light-emitting signal and the first switch transistor and the second switch transistor are turned off based on the scan signal, the first bypass transistor diverts the leakage current based on the data signal stored in the first bypass capacitor.

10. A light-emitting circuit, comprising:

a light-emitting unit a driving transistor, configured to drive the light-emitting unit a bypass circuit, electrically connected to a node between the light-emitting unit and the driving transistor, wherein the bypass circuit diverts a current flowing from the driving transistor to the light-emitting unit;

a light-emitting transistor, electrically connected between the light-emitting unit and the driving transistor, wherein the driving transistor generates a driving current and the light-emitting transistor provides the driving current to the light-emitting unit based on a light-emitting signal;

a first switch transistor, providing the data signal to an intermediate node based on a scan signal; and a second switch transistor, electrically connected between the intermediate node and a gate terminal of the driving transistor, wherein the second switch transistor provides the data signal of the intermediate node to the gate terminal of the driving transistor based on the scan signal so that the driving transistor generates the driving current based on the data signal, wherein when the driving transistor is turned off based on the data signal, the driving transistor generates a leakage current, wherein the bypass circuit diverts the leakage current flowing from the driving transistor to the light-emitting unit;

wherein the bypass circuit further comprises:

a first bypass transistor, electrically connected to a node between the light-emitting node and the light-emitting unit, wherein the first bypass transistor diverts the leakage current based on a voltage of a first bypass node;

a first bypass capacitor, electrically connected to the first bypass node and storing the voltage of the first bypass node;

a second bypass transistor, electrically connected to a node between the light-emitting transistor and the light-emitting unit and electrically connected to the first bypass transistor, wherein the gate terminal of the second bypass transistor receives the light-emitting signal;

a third bypass transistor, providing a supply voltage to the first bypass node based on a voltage of the gate terminal of the driving transistor; and a fourth bypass transistor, providing a second voltage to the first bypass node based on the second voltage.

11. The light-emitting circuit as defined in claim 10, wherein:

the first voltage does not exceed a ground voltage, wherein the other terminal of the first bypass capacitor is electrically connected to a reference voltage.

12. The light-emitting circuit as defined in claim 11, wherein:

when the light-emitting transistor and the fourth bypass transistor are turned off based on the light-emitting signal and the first switch transistor and the second switch transistor are turned on based on the scan signal, the fifth bypass transistor and the sixth bypass transistor act as an inverter and generate a voltage of the first bypass node according to the gate terminal of the driving transistor, wherein the first bypass capacitor stores the voltage of the first bypass node.

13. The light-emitting circuit as defined in claim 11, wherein:

when the light-emitting transistor and the fourth bypass transistor are turned on based on the light-emitting signal and the first switch transistor and the second switch transistor are turned off based on the scan signal, the first bypass transistor diverts the leakage current based on the voltage of the first bypass node.

* * * * *